US010316548B2

(12) United States Patent
Yuan

(10) Patent No.: US 10,316,548 B2
(45) Date of Patent: Jun. 11, 2019

(54) ACTUATOR ASSEMBLY FOR LOCKING DEVICES

(71) Applicants: Locway Technology Co., Ltd (Dongguan Guangdong, CN), Dongguan (CN); Dongguan ChongWei Metals & Plastic Products Factory Co., Ltd., Dongguan (CN)

(72) Inventor: Mengxiao Yuan, Dongguan (CN)

(73) Assignees: Locway Technology Co., Ltd., Dongguan (CN); Dongguan ChongWei Metals & Plastic Products Factory Co., Ltd., Dongguan (CN)

( * ) Notice: Subject to any disclaimer, the term of this patent is extended or adjusted under 35 U.S.C. 154(b) by 0 days.

(21) Appl. No.: 15/703,667

(22) Filed: Sep. 13, 2017

(65) Prior Publication Data

US 2018/0080254 A1 Mar. 22, 2018

(30) Foreign Application Priority Data

Sep. 20, 2016 (CN) ..... 2016 1 0834102

(51) Int. Cl.

| | |
|---|---|
| ***E05B 47/00*** | (2006.01) |
| ***E05B 65/52*** | (2006.01) |
| *E05B 15/04* | (2006.01) |
| *E05B 47/06* | (2006.01) |
| *E05B 1/00* | (2006.01) |

(52) U.S. Cl.

CPC ..... *E05B 47/0012* (2013.01); *E05B 65/52* (2013.01); *E05B 1/0038* (2013.01); *E05B 15/04* (2013.01); *E05B 47/0004* (2013.01); *E05B 47/0657* (2013.01); *E05B 2015/0406* (2013.01); *E05B 2047/0031* (2013.01); *E05B 2047/0037* (2013.01); *E05B 2047/0067* (2013.01)

(58) Field of Classification Search

CPC ..... E05B 47/0012; E05B 47/068; E05C 1/163

See application file for complete search history.

(56) References Cited

U.S. PATENT DOCUMENTS

| | | | | |
|---|---|---|---|---|
| 4,135,377 | A * | 1/1979 | Kleefeldt | E05B 81/25 292/144 |
| 4,949,563 | A * | 8/1990 | Gerard | E05B 47/026 292/144 |
| 5,339,662 | A * | 8/1994 | Goldman | E05B 47/0002 70/277 |
| 5,628,216 | A * | 5/1997 | Qureshi | E05B 47/0012 292/201 |
| 5,782,118 | A * | 7/1998 | Chamberlain | E05B 47/0012 70/277 |

(Continued)

*Primary Examiner* — Zakaria Elahmadi

(74) *Attorney, Agent, or Firm* — Wang Law Firm, Inc.

(57) ABSTRACT

This invention relates to locking devices and particularly to an actuator assembly for a locking device with electronic control. The actuator assembly includes: a motor, having a drive shaft installed to a motor shaft, and a coil spring installed to the drive shaft, and further includes: a follower shaft capable of displacing in an axial direction in the coil spring, and a pin installed onto the follower shaft and rotatable into the coil spring, and the follower shaft is extended into the coil spring and slidably fitted to the coil spring. Compared with the prior art, this invention effectively maintains a radial limitation of the cylinder spring to overcome the vibration of the spring occurred during the rotation of the cylinder spring and the axial displacement of the follower shaft.

8 Claims, 6 Drawing Sheets

(56) References Cited

U.S. PATENT DOCUMENTS 6,076,870 A * 6/2000 Frolov ..... E05B 47/0047 292/144
7,052,054 B2 * 5/2006 Luker ..... E05B 47/0012 292/199
7,303,215 B2 * 12/2007 Moon ..... E05B 47/0673 292/169
7,603,882 B2 * 10/2009 Carbajal ..... A47F 3/043 70/267
7,918,114 B2 * 4/2011 Walsh, III ..... E05B 47/0661 70/223
8,777,268 B2 * 7/2014 Holbein ..... B60R 22/03 280/805
9,181,730 B1 * 11/2015 Peng ..... E05B 47/0012
9,340,998 B2 * 5/2016 Mani ..... E05B 47/068
9,435,142 B2 * 9/2016 Carpenter ..... E05B 47/0012
9,850,685 B2 * 12/2017 Dore Vasudevan ..... E05B 47/0673
9,850,686 B2 * 12/2017 Carlsson ..... E05B 47/0012
10,047,544 B2 * 8/2018 Yen ..... E05B 47/0012
2006/0117820 A1 * 6/2006 Lanigan ..... B62D 33/0222 70/279.1
2008/0303290 A1 * 12/2008 Yuan ..... E05B 47/0012 292/195
2010/0122561 A1 * 5/2010 Lui ..... E05B 47/0673 70/277
2010/0294008 A1 * 11/2010 Bogdanov ..... E05B 47/0692 70/277
2012/0198897 A1 * 8/2012 Lui ..... E05B 47/0012 70/280
2013/0043751 A1 * 2/2013 Yuan ..... E05B 47/026 310/80
2015/0184425 A1 * 7/2015 Ellis ..... E05B 47/0012 292/144
2015/0184426 A1 * 7/2015 Arlinghaus ..... E05B 65/1053 292/138
2018/0155961 A1 * 6/2018 Lauer ..... E05B 47/0012

* cited by examiner

ACTUATOR ASSEMBLY FOR LOCKING DEVICES

FIELD OF INVENTION

The present invention relates to locking devices, in particular to an actuator assembly for a locking device with electronic control.

BACKGROUND OF INVENTION

1. Description of the Related Art

Conventional locking device with an electronic control generally adopts a locking assembly driven by a micro DC motor, and one of the technical solutions uses a coil spring sheathed on a shaft and a pin fixed to the shaft to convert a rotational motion of the motor into a linear motion between the spring and the pin, so as to push or pull a blocking element for controlling a lock bolt to retract.

As to the solution of using the rotation of the pin, when the pin moves spirally along the spring, the spring is compressed by the pressure of the pin, so that a larger friction is produced, and a rotational force of the spring and the shaft is produced by the friction, so that the spring may be rotated together with the shaft and jittered radially, and the spring cannot be displaced stably in the axial direction, and thus not just resulting the wear-out or damage between the spring and the sliding block only, but also failing to allow the pin to enter into the spiral track of the spring successfully. In addition, the friction between the pin and the spring may also wear out the pin and the spring. As disclosed in P.R.C. Pat. No. CN201110244325.0, a pin is rotated to push a pin to push the spring to displace axially, so as to push a blocking element to be stretched out or retracted. To overcome the unintentional rotation and jitter of the spring, a third winding of the spring is provided to absorb and buffer the vibrations and impacts of the pin exerted to the pin and produced when the motor is turned on and rotated, so as to prevent the spring from being twisted, deformed, or shaken.

Alternatively, the coil spring is fixed onto the drive shaft of the motor and rotated together with the motor, and the pin is fixed to an axially slidable blocking element in order to achieve the effect of pushing or pulling the blocking element into a locked position or an unlocked position. As disclosed in U.S. Pat. No. 5,628,216 issued to Schlage Lock Company, a locking device is installed to a door lock and comprises a motor, a gear set coupled to the motor, a guiding shaft coupled to the gear set, a coil spring fixed to a free end of a cylinder of the guiding shaft and partially stretched coaxially into a bushing of a plug, and a pin perpendicularly installed to the bushing of the plug while passing through two adjacent rounds of the spring of the bushing of the plug. The motor drives the coil spring to rotate, and the pin is rotated into the two adjacent rounds of the coil spring, so that the bushing of the plug slides along the axis of the motor shaft and between a locked position and an unlocked position to control locking and unlocking the door lock.

Another patent further discloses a locking device of a door lock, and the difference between this patent and the aforementioned patent resides on that the pin of this patent is installed to a frame of a protrusion formed at an end of a locking plate, and a coil spring is passed through from the interior of the frame, and the pin is inserted between two adjacent rounds of the spring, and the locking plate is shifted axially between the locked position and the unlocked position under the precession effect of the spring and the pin.

The technical solutions provided by the foregoing patented technology have the following advantages. Since the spring and the drive shaft are fixed, the inertia of the rotation is small, and there is no issue on the rotation and radial shaking of the spring. However, there is still an unsatisfactory result. For example, the load (including the bushing of the plug and the locking plate) has relatively larger volume and weight, so that when the spring is rotated into the pin, the spring is pulled and stretched, and the friction in contact with the pin is increased, and the spring and pin may be worn out or damaged easily.

In addition, some actuator assemblies require a spring with a fixed end and a non-fixed longer end, so that when a portion of the actuator assembly away from the drive shaft is rotated, there is no radial limitation, and a swinging deviated from the axis may be produced to cause vibrations of the spring.

Obviously, the technical solution of 'converting the rotational motion of the motor into the linear motion between the coil spring and the pin for the interaction of the pin and coil in order to push or pull a blocking element for controlling a locking device' requires further improvements.

2. Summary of the Invention

Therefore, it is a primary objective of the present invention to provide an actuator assembly for a locking device, and the actuator assembly is capable of preventing the vibration produced by the rotation of the spring and reducing the friction between the pin and the spring.

To achieve the aforementioned and other objectives, the present invention provides an actuator assembly for a locking device with electronic control, comprising: a motor, having a drive shaft installed to a motor shaft, and a coil spring installed to the drive shaft, characterized in that the actuator assembly further comprises: a follower shaft capable of displacing in an axial direction in the coil spring, and a pin installed onto the follower shaft and rotatable into the coil spring, and the follower shaft is extended into the coil spring and slidably fitted to the coil spring.

Wherein, the coil spring is a cylinder spring comprising a rotating-in portion and a buffering portion, and the pin displaces axially within a range of the rotating-in portion.

Wherein, the buffering portion has a plurality of tightly wound windings with a pitch equal to zero, and the rotating-in portion has a pitch greater than the diameter of the pin.

Wherein, the external diameter of the follower shaft and the internal diameter of the cylinder spring have a unilateral gap of 0.15 mm~0.30 mm, and the rotating-in portion has a pitch equal to 1.1~1.3 times of the diameter of the pin.

Wherein, the cylinder spring has a first fixing ring and a second fixing ring installed at two free ends of the cylinder spring respectively, a first U-shaped bend coupled to the first fixing ring, and a second U-shaped bend coupled to the second fixing ring; the drive shaft has a ring-shaped protruding strip formed thereon, and the ring-shaped protruding strip comprises a protruding strip head matched with the first U-shaped bend, and the first U-shaped bend is sheathed on the protruding strip head, and the first fixing ring is installed to the outer side of the ring-shaped protruding strip.

Wherein, the follower shaft has a cylindroid disposed at an end of the follower shaft and protruded out from the outer peripheral surface of the follower shaft.

Wherein, the drive shaft includes a first shaft shoulder and a second shaft shoulder, a fixing frame installed between the drive shaft and the motor housing, and the fixing frame includes two fixing rods fixed to the motor housing and a third U-shaped bend perpendicular to the fixing rod, and the third U-shaped bend is disposed between the first shaft shoulder and the second shaft shoulder for limiting the axial displacement of the drive shaft.

Wherein, the fixing frame is formed by bending a steel wire, and the third U-shaped bend has a diameter smaller than the first shaft shoulder and greater than the second shaft shoulder.

Wherein, the motor shaft is a flat shaft, and the drive shaft includes a flat shaft hole matched with the flat shaft.

Wherein, the follower shaft includes a pin hole, and the pin has a head disposed between two adjacent rounds of the coil spring and a tail fixed to the pin hole.

In summation, the present invention has the following advantageous effects:

1. Compared with the prior art, the follower shaft of the present invention effectively maintains a radial limitation of the cylinder spring to overcome the vibration of the spring occurred during the rotation of the cylinder spring and the axial displacement of the follower shaft.

2. The cylinder spring of the present invention has the structure of the buffering portion, and when the pin displaces axially with respect to the cylinder spring, the buffering portion is also pulled and stretched, so that the rotating-in portion of the spring is pulled and stretched and the compression is reduced to effectively reduce the friction between the pin and the spring, so as to minimize the wear-out and damage of components.

3. The actuator assembly for the locking device in accordance with the present invention has the features of small number of components, simple structure, and easy manufacture and installation.

DESCRIPTION OF THE PREFERRED EMBODIMENTS

The above and other objects, features and advantages of this disclosure will become apparent from the following detailed description taken with the accompanying drawings.

Figure 1:
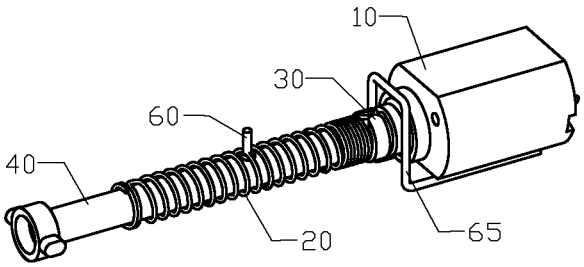
FIG. 1 is a perspective view of a preferred embodiment of the present invention.
Figure 2:
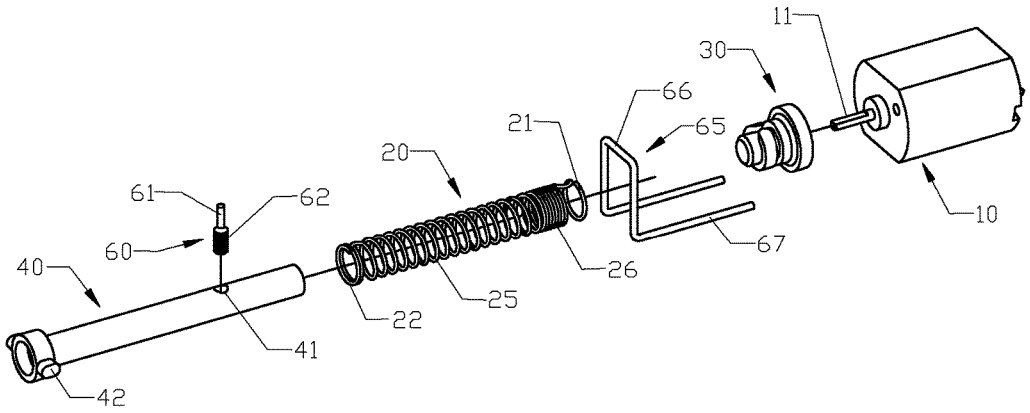
FIG. 2 is an exploded view of a preferred embodiment of the present invention.

With reference to FIGS. 1 and 2 for an actuator assembly in accordance with a preferred embodiment of the present invention, the actuator assembly comprises a motor 10, a drive shaft 30, a cylinder spring 20, a follower shaft 40, and a pin 60. The motor 10 is a general DC motor, and the drive shaft 30 and the motor shaft 11 are flat shafts in coordination with the torque of transmission, and the motor shaft 11 and the shaft hole 35 of the drive shaft are interference fitted and fixed. The two free ends of the cylinder spring 20 are configured in 1~2 rounds of first fixing ring 21 and second fixing ring 22, and the first fixing ring 21 and the second fixing ring 22 are a first U-shaped bend 23 and a second U-shaped bend 24 coupled to each other in opposite directions and having the same shape, and the drive shaft 30 has a non-closed ring-shaped protruding strip 31, and the ring-shaped protruding strip 31 includes two protruding strip heads 32, and one of the protruding strip head is matched with the first U-shaped bend 23, and the first U-shaped bend 23 is embedded precisely into one of the protruding strip heads 32, and the first fixing ring 21 is sheathed on the outer side of the protruding strip head 32, and the axial displacement of the cylinder spring 20 is limited by the ring-shaped protruding strip 31, and the radial displacement of the cylinder spring 20 with respect to the drive shaft 30 is limited by the first U-shaped bend 23 and the protruding strip head 32. The pin 60 may be installed on the follower shaft 40 by stretching the two pin heads symmetrically out from the external periphery of the follower shaft 40, or stretching a pin head in a single direction, depending on the object driven by the actuator assembly. In this preferred embodiment, the object driven by the present invention is a rotatable dial lever 50 disposed under the follower shaft 40, so that it is not necessary to have two pin heads as long as a pin head 61 of the pin 60 is installed into a chute 55 of a dial lever 50. When the pin 60 displaces linearly, the pin head 61 is acted to the chute 55 to push the dial lever 50 to rotate. A pin tail 62 has a diameter greater than the diameter of the pin head 61, and interference fitted with the pin hole 41, so that the external periphery of the pin tail 62 has a knurling. When the motor 10 drives the cylinder spring 20 to rotate, the pin 60 is limited by the chute 55 and will not be moved with the cylinder spring 20, and the pin 60 can be displaced in an axial direction along the cylinder spring 20 (as shown in FIGS. 6 and 7).

Figure 3:
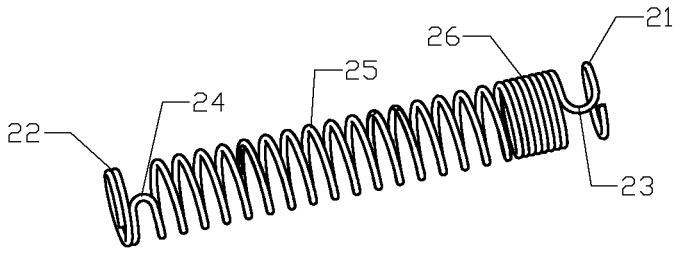
FIG. 3 is a perspective view of a cylinder spring of a preferred embodiment of the present invention.

With reference to FIG. 3 for the structure of the cylinder spring 20, the cylinder spring 20 includes a rotating-in portion 25 with a relatively larger pitch and capable of being rotated into the pin 60 and a buffering portion 26 having a plurality of tightly wound windings with a pitch approaching zero, and the rotating-in portion has approximately 15~17 rounds, and the pitch is 1.1~1.3 times of the diameter of the pin 60, and the buffering portion 26 is wound tightly with 7~9 rounds. The tightly section provides an effect of buffering the pushing force of the pin 60 exerted to the rotating-in portion 25, and the pushing force pulls and stretches the rotating-in portion 25. After such section of the buffering portion 26 is wound tightly, and the rotating-in portion 25 receives the tensile force, the buffering portion 26 is also pulled and stretched. Provided that the total stretch of the spring remains unchanged, the pulling/stretching force of each round of the spring is reduced, so that the pulling/stretching force exerted onto the rotating-in portion 25 is reduce, so as to decrease the friction between the cylinder spring 20 and the pin 60 and minimize the wear-out or damage of the cylinder spring 20 and the pin 60.

Figure 4:
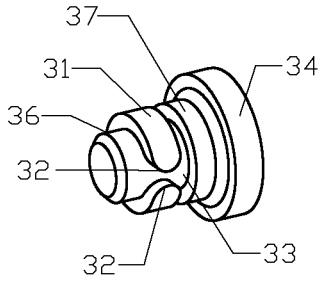
FIG. 4 is a perspective view of a drive shaft of a preferred embodiment of the present invention.
Figure 5:
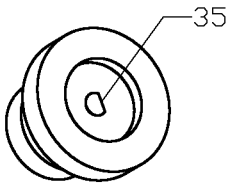
FIG. 5 is another perspective view of a drive shaft of a preferred embodiment of the present invention.
Figure 6:
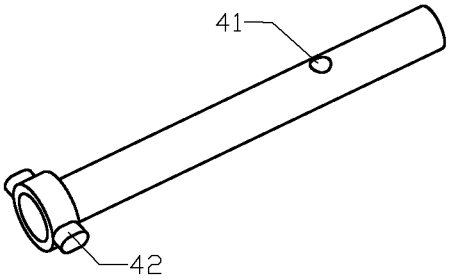
FIG. 6 is a perspective view of a follower shaft of a preferred embodiment of the present invention.

With reference to FIGS. 4, 5 and 6 for a drive shaft 30 and a follower shaft 40 of the invention, the drive shaft 30 includes a first shaft shoulder 34 adjacent to the motor 10, a second shaft shoulder 37 disposed adjacent to the first shaft shoulder 34, a shaft neck 33 disposed adjacent to the second shaft shoulder 37, a ring-shaped protruding strip 31 disposed adjacent to the shaft neck 33, and a shaft extension 36 disposed adjacent to the ring-shaped protruding strip 31. The first fixing ring 21 of the cylinder spring 20 is sheathed on the shaft neck 33, and the first U-shaped bend 23 is latched to the protruding strip head 32, and the tightly wound buffering portion 26 has a several rounds sheathed on the shaft extension. The pin hole 41 is formed at an end of the follower shaft 40 proximate to motor shaft 11. After the follower shaft 40 is installed in the cylinder spring 20, the pin hole 41 is disposed precisely at the center position of the rotating-in portion 25.

Figure 7:
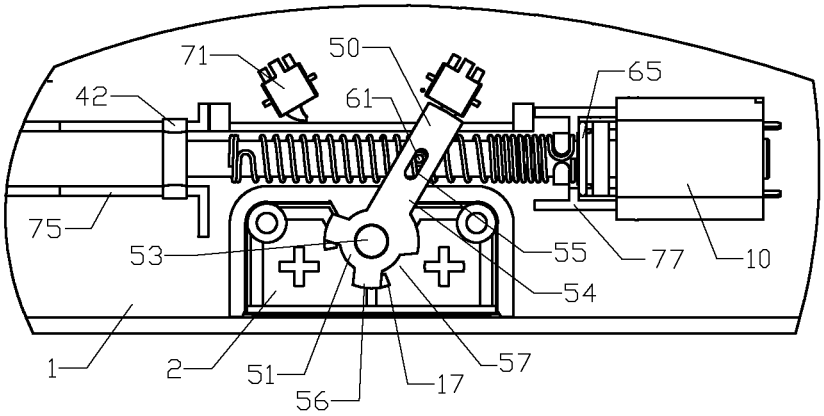
FIG. 7 is a schematic view of a dial lever installed at a panel device being situated in a locked position in accordance with a preferred embodiment of the present invention.
Figure 8:
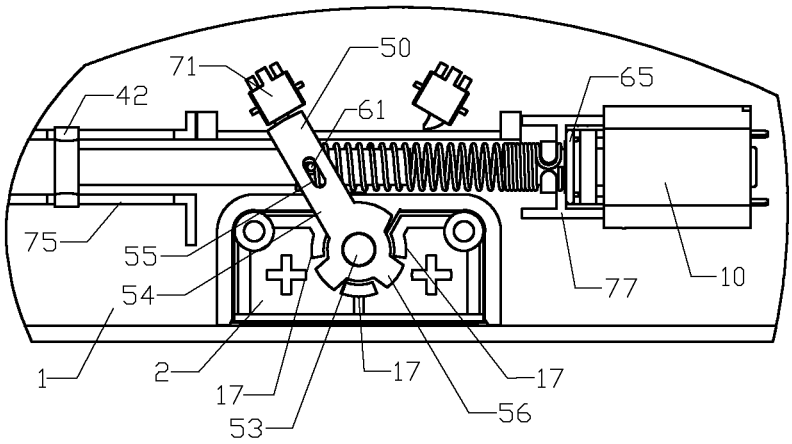
FIG. 8 is a perspective view of a dial lever installed at a panel device being situated in an unlocked position in accordance with a preferred embodiment of the present invention.

In FIGS. 7 and 8, the follower shaft 40 has a length greater than the length of the cylinder spring 20. When the follower shaft 40 is situated at a sliding-in position, the follower shaft 40 keeps stretching to the buffering portion 26. When the follower shaft 40 is situated at a sliding-out position, half of the rotating-in portion 25 is still sheathed on the follower shaft 40. During the process of rotating the cylinder spring 20 and displacing the follower shaft 40 axially, the follower shaft 40 maintains the radial limitation of the cylinder spring 20. The follower shaft 40 has a diameter slightly smaller than the diameter of the internal periphery of the cylinder spring, so that the unilateral gap between the follower shaft 40 and the cylinder spring will not affect the slide fit in the axial direction, and preferably the deviation is minimized when the cylinder spring is rotated. In this preferred embodiment, the unilateral gap has a numerical range of 0.15 mm~0.30 mm.

The slidably fitted end of the follower shaft 40 and the locking device has two symmetrical protruding cylindroid 42, and the rail matched with the two cylindroids 42 is composed of an upper rail 75 of the panel 1 (as shown in FIG. 7) and a lower rail (not shown in the figure) of the bottom plate, and the upper rail 75 has two recessions formed on the two parallel rectangular strips for exactly receiving the cylindroid 42, and the lower rail is composed of two rectangular strips (not shown in the figure) and two protrusions concavely recessed and disposed opposite to each other, after the panel 1 and the bottom plate are assembled, the cylindroid 42 is disposed between the upper rail 75 and the lower rail, and a slidably fitted gap is maintained between the cylindroid 42 and the rails. The drive shaft 30 and the follower shaft 40 may be made of metal or engineering plastics. In this preferred embodiment, nylon is adopted. To reduce the weight, the follower shaft 40 comes with a hollow structure.

With reference to FIGS. 7 and 8 for a panel device of a mechanical locking button in accordance with a preferred embodiment of the present invention, the panel device includes a panel 1 installed onto a suitcase cover, a bottom plate (not shown in the figure) matched with the panel 1, a button 2 installed onto the panel 1, a dial lever 50 installed under the stroke of the button 2 for controlling whether or not the button 2 can be pressed, and the actuator assembly of the present invention is installed on a side of the button 2. The dial lever 50 includes a hub 51, and the hub 51 has a pivot 53, and a pivot hole (not shown in the figure) matched with the pivot and formed between the panel 1 and the bottom plate, and the dial lever 50 may be rotated around the pivot hole, and an arm 54 extended out from the hub 51, and the arm 54 has a chute 55 installable into the pin head 61, and the hub 51 has three first teeth 56 and three adjacent first grooves 57, and the first protrusion 17 formed the inner plane of the button 2 may enter into of the first groove 57. When the dial lever is situated at a first angle, the three first teeth 56 and the three first protrusions 17 are opposite to each other. Now, the downward stroke of the button 2 is blocked by the first teeth 56 of the dial lever 50, so that the button 2 cannot be pressed down. When the dial lever 50 is pushed by the pin head 61 to a second angle, the first groove 57 and the first protrusion 17 are opposite to each other, and the downward stroke of the button 2 is not blocked. When the button 2 is pressed, the first protrusion 17 enters into the first groove 57. Since a longer arm is installed between the pin 60 and the pivot 53, the pin 60 can push the dial lever 50 to rotate by a small force in order to lock and unlock the button 2. The panel 1 further has a first position switch 71, and an end of the arm 54 touches the first position switch 71 at a predetermined angle, and the position of the dial lever 50 is transmitted to a control unit of the locking device.

In FIG. 7, the locking device is situated at the locked position, and the rotating-in portion 25 and buffering portion 26 of the cylinder spring are pulled and stretched, and the first tooth 56 of the dial lever 50 and the first protrusion 17 of the button 2 abut each other to block pressing the button 2 (wherein the button 2 is pressed in a direction from the surface as shown in FIGS. 6 and 7). After the unlock authorization is received, the motor 10 drives the cylinder spring 20 to rotate, and the pushing force produced by rotating the follower shaft 40 by the pin 60 into the cylinder spring 20 slides from the locked position axially to the unlocked position, and the pin 60 is acted to the chute 55 to push the dial lever 50 to rotate an angle, and the first tooth 56 of the dial lever 50 is detached from the abutment of the first protrusion 17. In the process of rotating the first groove 57 to reach a position opposite to the first protrusion 17, the pin 60 is displaced to the left side of the cylinder spring 20 round by round, and the pulling/stretching force is decreased gradually. Now, an end of an arm 54 has touched the first position switch 71 (as shown in FIG. 8). Now, the button 2 is pressed, and there is no blocking, so that the suitcase can be opened after the button 2 is pressed. After the external force pressing at the button 2 is released, a restoring spring (not shown in the figure) resets the button 2. After the button 2 is reset, if the control unit of the locking device sends out a locking signal, the motor 10 will be rotated in the reverse direction, and the cylinder spring 20 starts displacing towards the left side of the pin 60 round by round. In the meantime, the pulling/stretching force is increased gradually until the pin 60 pushes the dial lever 3 back to the locked position to resume blocking the button 2.

In the structure of a fixing frame 65 as shown in FIGS. 1 and 2, a fixing frame 65 is installed between the drive shaft 30 and the motor 10 to prevent the drive shaft 30 from being displaced axially or separated from the motor shaft. The fixing frame 65 is formed by bending a slightly thick steel wire, and the third U-shaped bend 66 perpendicular to the drive shaft 30 has a diameter smaller than the first shaft shoulder 34 and greater than second shaft shoulder 37, and is disposed on an inner side of the second shaft shoulder 37, and two symmetrical free ends of the third U-shaped bend 66 and the third U-shaped bend 66 form a right angle, so that a pair of fixing rods 67 are pressed under the housing of the motor 10. After the motor 10 is fixed by the panel 1 and the bottom plate, the fixing frame 65 is then fixed. In normal conditions, the third U-shaped bend 66 is not in contact with the second shaft shoulder 37 and any part of the drive shaft 40. When the drive shaft 30 is displaced towards the cylinder spring 20, the U-shaped bend is contacted with the second shaft shoulder 37 to stop the drive shaft 30 to continue its axial displacement. To achieve a reliable effect, a pair of L-shaped protrusions 77 are installed at a position of the panel 1 corresponding to the shaft neck 33 to block the inner side of the third U-shaped bend 66. When the fixing frame 65 is pushed inwardly, the L-shaped protrusion 77 has the effect of supporting the fixing frame 65.

While the invention has been described by means of specific embodiments, numerous modifications and variations could be made thereto by those skilled in the art without departing from the scope and spirit of the invention set forth in the claims.

What is claimed is:

1. An actuator assembly for a locking device, comprising:

a motor, a drive shaft installed to the motor shaft, and a coil spring installed to the drive shaft, characterized in that the actuator assembly further comprises:

a follower shaft capable of displacing in an axial direction in the coil spring, and a pin installed onto the follower shaft and rotatable into the coil spring, and the follower shaft is extended into the coil spring and slidably fitted to the coil spring;

wherein the coil spring is a cylinder spring comprising a rotating-in portion and a buffering portion, the pin displaces axially within a range of the rotating-in portion, the cylinder spring has a first fixing ring and a second fixing ring installed at two free ends of the cylinder spring respectively, a first U-shaped bend coupled to the first fixing ring, and a second U-shaped bend coupled to the second fixing ring, the drive shaft has a ring-shaped protruding strip formed thereon, and the ring-shaped protruding strip comprises a protruding strip head matched with the first U-shaped bend, and the first U-shaped bend is sheathed on the protruding strip head, and the first fixing ring is installed to the outer side of the ring-shaped protruding strip.

2. The actuator assembly for a locking device according to claim 1, wherein the buffering portion has a plurality of tightly wound windings with a pitch equal to zero, and the rotating-in portion has a pitch greater than the diameter of the pin.

3. The actuator assembly for a locking device according to claim 2, wherein the external diameter of the follower shaft and the internal diameter of the cylinder spring have a unilateral gap of 0.15 mm~0.30 mm, and the rotating-in portion has a pitch equal to 1.1~1.3 times of the diameter of the pin.

4. The actuator assembly for a locking device according to claim 1, wherein the follower shaft has a cylindroid disposed at an end of the follower shaft and protruded out from the outer peripheral surface of the follower shaft.

5. The actuator assembly for a locking device according to claim 1, wherein the drive shaft includes a first shaft shoulder and a second shaft shoulder, a fixing frame installed between the drive shaft and the motor housing, and the fixing frame includes two fixing rods fixed to the motor housing and a third U-shaped bend perpendicular to the fixing rod, and the third U-shaped bend is disposed between the first shaft shoulder and the second shaft shoulder for limiting the axial displacement of the drive shaft.

6. The actuator assembly for a locking device according to claim 5, wherein the fixing frame is formed by bending a steel wire, and the third U-shaped bend has a diameter smaller than the first shaft shoulder and greater than the second shaft shoulder.

7. The actuator assembly for a locking device according to claim 1, wherein the motor shaft is a flat shaft, and the drive shaft includes a flat shaft hole matched with the flat shaft.

8. The actuator assembly for a locking device according to claim 1, wherein the follower shaft includes a pin hole, and the pin has a head disposed between two adjacent rounds of the coil spring and a tail fixed to the pin hole.

* * * * *